US009016095B2

(12) United States Patent
Dudgeon et al.

(10) Patent No.: US 9,016,095 B2
(45) Date of Patent: Apr. 28, 2015

(54) MULTIPLE USER LOCKBOX

(71) Applicant: Master Lock Company LLC, Oak Creek, WI (US)

(72) Inventors: Matthew T. Dudgeon, Whitefish Bay, WI (US); Scott B. Stevens, St. Francis, WI (US)

(73) Assignee: Master Lock Company LLC, Oak Creek, WI (US)

( * ) Notice: Subject to any disclaimer, the term of this patent is extended or adjusted under 35 U.S.C. 154(b) by 109 days.

(21) Appl. No.: 13/832,207

(22) Filed: Mar. 15, 2013

(65) Prior Publication Data

US 2014/0130722 A1 May 15, 2014

Related U.S. Application Data

(60) Provisional application No. 61/724,338, filed on Nov. 9, 2012.

(51) Int. Cl.
*E05B 65/52* (2006.01)
*E05G 1/04* (2006.01)
(Continued)

(52) U.S. Cl.
CPC .. *E05G 1/04* (2013.01); *E05G 1/06* (2013.01); *E05G 1/08* (2013.01)

(58) Field of Classification Search
CPC ..... E05B 19/0005; E05B 65/006; E05B 65/0075; E05B 65/02; E05G 1/00; E05G 1/04; E05G 1/06; E05G 1/08
USPC ..... 70/63, 158–162, 164, 456 R, DIG. 63; 206/37.4; 109/53, 56, 57, 59 R, 59 T, 109/64, 66; 232/44, 45; 312/245, 327, 328; 220/210, 315, 324
See application file for complete search history.

(56) References Cited

U.S. PATENT DOCUMENTS 1,177,093 A * 3/1916 Evans ..... 70/30
1,719,120 A 7/1929 Miles
(Continued)

FOREIGN PATENT DOCUMENTS

| | | | |
|---|---|---|---|
| CH | 674395 | | 5/1990 |
| FR | 2773539 | | 7/1999 |
| GB | 2181781 | * | 4/1987 |

OTHER PUBLICATIONS

International Search Report and Written Opinion of the International Searching Authority from International Application No. PCT/US2013/067191, dated Mar. 28, 2014, pp. 9.
(Continued)

*Primary Examiner* — Lloyd Gall
(74) *Attorney, Agent, or Firm* — Calfee, Halter & Griswold LLP

(57) ABSTRACT

A lockbox includes a body and a lid connected to body and pivotable between a closed position and an open position. The body defines an enclosure and includes a body aperture and the lid includes a first lid aperture positioned adjacent to the body aperture when the lid is in the closed position, such that insertion of a padlock shackle through the body aperture and the lid aperture prevents pivoting movement of the lid from the closed position to the open position. The lockbox includes a slot intersecting one of the body aperture and the lid aperture for insertion of an item into the enclosure when the lid is in the closed position. A padlock shackle inserted through the body aperture and the lid aperture prevents passage of an item through the slot.

9 Claims, 10 Drawing Sheets

(51) Int. Cl.
*E05G 1/06* (2006.01)
*E05G 1/08* (2006.01)

(56) References Cited

U.S. PATENT DOCUMENTS

| | | | | | |
|---|---|---|---|---|---|
| 1,877,910 | A | | 9/1932 | L'Enfant | |
| 1,877,912 | A | | 9/1932 | L'Enfant | |
| 2,219,561 | A | | 10/1940 | Miller | |
| 2,485,051 | A | | 10/1949 | Joslin | |
| 2,635,665 | A | | 4/1953 | Ashley | |
| 2,704,101 | A | | 3/1955 | Wittrien | |
| 2,716,882 | A | * | 9/1955 | Vold et al. | 70/159 |
| 2,859,789 | A | | 11/1958 | Buckett | |
| 2,875,803 | A | | 3/1959 | Greene et al. | |
| 2,889,050 | A | | 6/1959 | Modrey | |
| 3,318,354 | A | | 5/1967 | Borisof | |
| 3,415,300 | A | | 12/1968 | Worcester | |
| 3,563,293 | A | | 2/1971 | Fisher | |
| 3,568,482 | A | | 3/1971 | Shears | |
| 3,606,777 | A | | 9/1971 | Watson | |
| 3,716,091 | A | | 2/1973 | Gaines | |
| 3,926,234 | A | | 12/1975 | Dean | |
| 3,933,017 | A | | 1/1976 | Shee | |
| 4,006,614 | A | * | 2/1977 | Decker | 70/63 |
| 4,072,033 | A | | 2/1978 | Eckerdt | |
| 4,286,641 | A | | 9/1981 | Watson | |
| 4,296,617 | A | * | 10/1981 | Campagna | 70/63 |
| 4,306,433 | A | | 12/1981 | Kelly | |
| 4,331,194 | A | | 5/1982 | Lederer | |
| 4,356,956 | A | | 11/1982 | Long | |
| D275,055 | S | | 8/1984 | Davis | |
| 4,523,692 | A | | 6/1985 | Lemkin | |
| 4,653,785 | A | | 3/1987 | Tobey | |
| 4,796,750 | A | | 1/1989 | Inghram | |
| 4,799,587 | A | | 1/1989 | Desanto | |
| 4,901,549 | A | | 2/1990 | Dengel | |
| 5,020,342 | A | | 6/1991 | Doan et al. | |
| 5,046,343 | A | | 9/1991 | Miwa | |
| 5,123,579 | A | | 6/1992 | Sugiyama | |
| 5,129,536 | A | * | 7/1992 | Robinson | 220/211 |
| 5,191,974 | A | | 3/1993 | Saalman | |
| 5,365,757 | A | | 11/1994 | Primeau | |
| 5,641,065 | A | | 6/1997 | Owens et al. | |
| 5,653,332 | A | | 8/1997 | DeWitt, Jr. | |
| 5,738,020 | A | | 4/1998 | Correia | |
| 5,799,774 | A | | 9/1998 | Dengel | |
| 5,829,580 | A | | 11/1998 | Schroeter | |
| 6,047,573 | A | | 4/2000 | Martinez | |
| D427,901 | S | | 7/2000 | Lentini | |
| 6,085,671 | A | | 7/2000 | Kerr et al. | |
| 6,148,993 | A | | 11/2000 | Chisolm et al. | |
| 6,247,609 | B1 | | 6/2001 | Gabele et al. | |
| 6,363,759 | B1 | * | 4/2002 | Ive et al. | 70/58 |
| D539,633 | S | | 4/2007 | Van Handel | |
| 7,360,380 | B2 | | 4/2008 | Van Handel | |
| 2002/0108410 | A1 | | 8/2002 | Webb et al. | |
| 2004/0040351 | A1 | * | 3/2004 | Alcott | 70/63 |
| 2005/0199628 | A1 | | 9/2005 | Van Handel et al. | |
| 2006/0042331 | A1 | * | 3/2006 | Benda | 70/63 |
| 2006/0162403 | A1 | * | 7/2006 | Handel | 70/63 |
| 2008/0203869 | A1 | * | 8/2008 | Mallory | 312/245 |
| 2008/0237232 | A1 | * | 10/2008 | Cohn et al. | 220/210 |
| 2010/0147853 | A1 | | 6/2010 | Hackett | |
| 2012/0198895 | A1 | * | 8/2012 | De Maria | 70/63 |
| 2012/0206029 | A1 | * | 8/2012 | Zabbatino | 312/404 |
| 2013/0099641 | A1 | * | 4/2013 | Saucier et al. | 312/237 |

OTHER PUBLICATIONS

International Search Report from PCT/US/2005/008409, International Preliminary Report on Patentabiltiy and Written Opinion from PCT/US2005/039418, dated May 10, 2007.

* cited by examiner

MULTIPLE USER LOCKBOX

CROSS-REFERENCE TO RELATED APPLICATIONS

This application claims priority to and the benefit of U.S. Provisional Patent Application Ser. No. 61/724,338, entitled "MULTIPLE USER LOCKBOX" and filed Nov. 9, 2012, the entire disclosure of which is incorporated herein by reference.

BACKGROUND

Many safety lockout devices are provided for restricting access to equipment and control instruments, including, for example, electrical components, such as switches, dials and push buttons, and fluid system components, such as valves and pressure regulators. Industrial and commercial equipment are often provided with or assembled with a key-operated lockout mechanism (e.g., a locking bracket and padlock or similar structure) to facilitate the restriction of access to or operation of the equipment.

In some applications, the authorization of multiple technicians or other authorized personnel is required to allow access to, or operation of, a locked out system or piece of equipment, for example, to comply with established safety procedures. In such an application, the use of multiple keys controlled by multiple users may be required to unlock the one or more lockout mechanisms to place the equipment in an operable condition.

SUMMARY

According to an exemplary embodiment of the present application, a lockbox includes a body and a lid connected to body and pivotable between a closed position and an open position. The body includes a body aperture and the lid includes a first lid aperture positioned adjacent to the body aperture when the lid is in the closed position, such that insertion of a padlock shackle through the body aperture and the lid aperture prevents pivoting movement of the lid from the closed position to the open position. The lockbox includes a key slot intersecting one of the body aperture and the lid aperture for insertion of a key into an enclosure when the lid is in the closed position. A padlock shackle inserted through the body aperture and the lid aperture prevents passage of a key through the key slot.

According to another exemplary embodiment of the present application, a method of securely storing a plurality of keys associated with a plurality of authorized users is described. In the exemplary method, a lockbox is provided having a body defining a storage enclosure and a lid connected to the body and pivotable between a closed position blocking access to the enclosure and an open position permitting access to the enclosure. With the lid in the closed position, a first key associated with a first authorized user is inserted through a first key slot into a first compartment disposed within the enclosure. A first padlock associated with the first authorized user is secured through a first body aperture disposed in the body and through a first lid aperture disposed in the lid to secure the lid in the closed position. A second key associated with a second authorized user is inserted through a second key slot into a second compartment disposed within the enclosure. A second padlock associated with the second authorized user is secured through a second body aperture disposed in the body and through a second lid aperture disposed in the lid to secure the lid in the closed position.

According to another exemplary embodiment of the present application, a lockbox includes a body defining a storage enclosure and a lid connected to body and pivotable between a closed position blocking access to the enclosure and an open position permitting access to the enclosure. The lid includes first, second, third, and fourth perimeter edge portions that align with corresponding first, second, third and fourth perimeter walls of the body when the lid is in the closed position. A latch is assembled with the lid and is slideable between a latching position in interlocking engagement with a latch engaging portion of the body when the lid is in the closed position, and a releasing position disengaged from the latch engaging portion of the body. The first perimeter wall includes a first end flange positioned to abut the first perimeter edge portion of the lid when the lid is in the closed position, the first end flange including a first body aperture that aligns with a first lid aperture in the first perimeter edge portion of the lid, such that insertion of a lock member through the first body aperture and the first lid aperture prevents pivoting movement of the lid from the closed position to the open position. When the latch is in the latching position, a first cutout of the latch aligns with the first lid aperture, such that insertion of a lock member through the first body aperture and the first lid aperture further prevents sliding movement of the latch from the latching position to the releasing position.

BRIEF DESCRIPTION OF THE DRAWINGS

Further features and advantages of the invention will become apparent from the following detailed description made with reference to the accompanying drawings, wherein.

DETAILED DESCRIPTION

The Detailed Description merely describes exemplary embodiments is not intended to limit the scope of the claims in any way. Indeed, the invention as claimed is broader than and unlimited by the exemplary embodiments, and the terms used in the claims have their full ordinary meaning Also, while specific exemplary embodiments in the present application describe padlock secured group lockboxes and lockout stations for storing multiple keys for unlocking locked out portions of a system or equipment, one or more of the features described herein may additionally or alternatively be applied to other types of locking enclosures (e.g., safes, mailboxes, drop boxes, etc.) and to other types of locking mechanisms (e.g., combination padlocks, electronic locks, RFID locks, built-in key operated locks, combination locks, remote controlled locks, biometric operated locks, etc.).

According to an aspect of the present application, a locking enclosure is provided with multiple locking points, such that the cooperation of multiple authorized users may be required to open the enclosure. When two or more locking points of the enclosure are secured in a locked condition, each of the two or more locking points must be unlocked or released to open the enclosure. In one such embodiment, a locking enclosure may be provided with multiple sets of lock apertures, with the locking enclosure being configured to be secured in a closed condition when a padlock shackle or other such locking member (e.g., a cable lock, pin lock, zip tie) is secured through at least one of the sets of lock apertures.

As one example, a lockbox may be provided with a body and a lid movable (e.g., pivoting hinged movement, sliding movement, or fully removable) between a closed position securing one or more items within the lockbox, and an open position permitting access to, or the depositing of, items in the lockbox. The lid may be secured in the closed position by corresponding lock apertures in the body and in the lid. When a shackle (or other such locking member) is inserted through the corresponding body and lid apertures, movement of the apertured lid portion with respect to the apertured body portion is restricted to secure the lid in the closed position.

Figure 1:
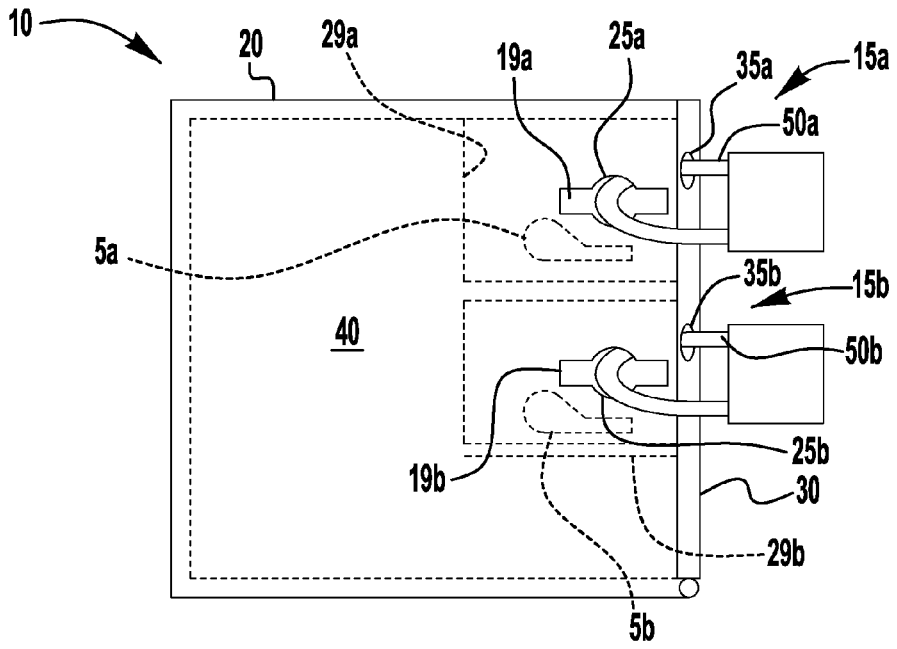
FIG. 1 illustrates a side schematic view of an exemplary lockbox, shown in a closed position.
Figure 2:
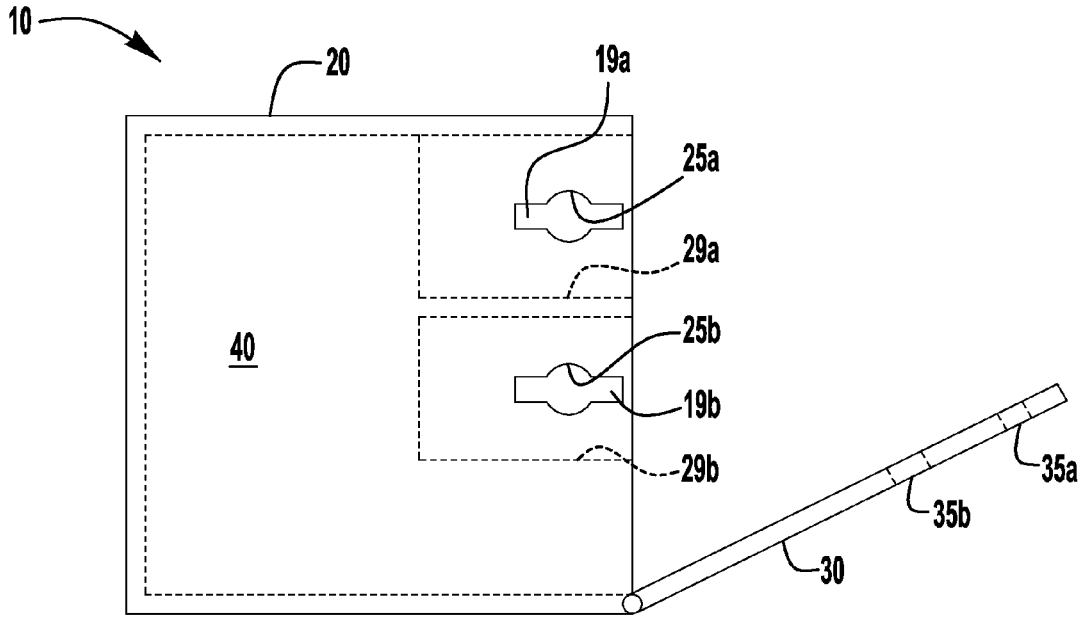
FIG. 2 illustrates a side schematic view of the lockbox of FIG. 1, shown in an open position.
Figure 3:
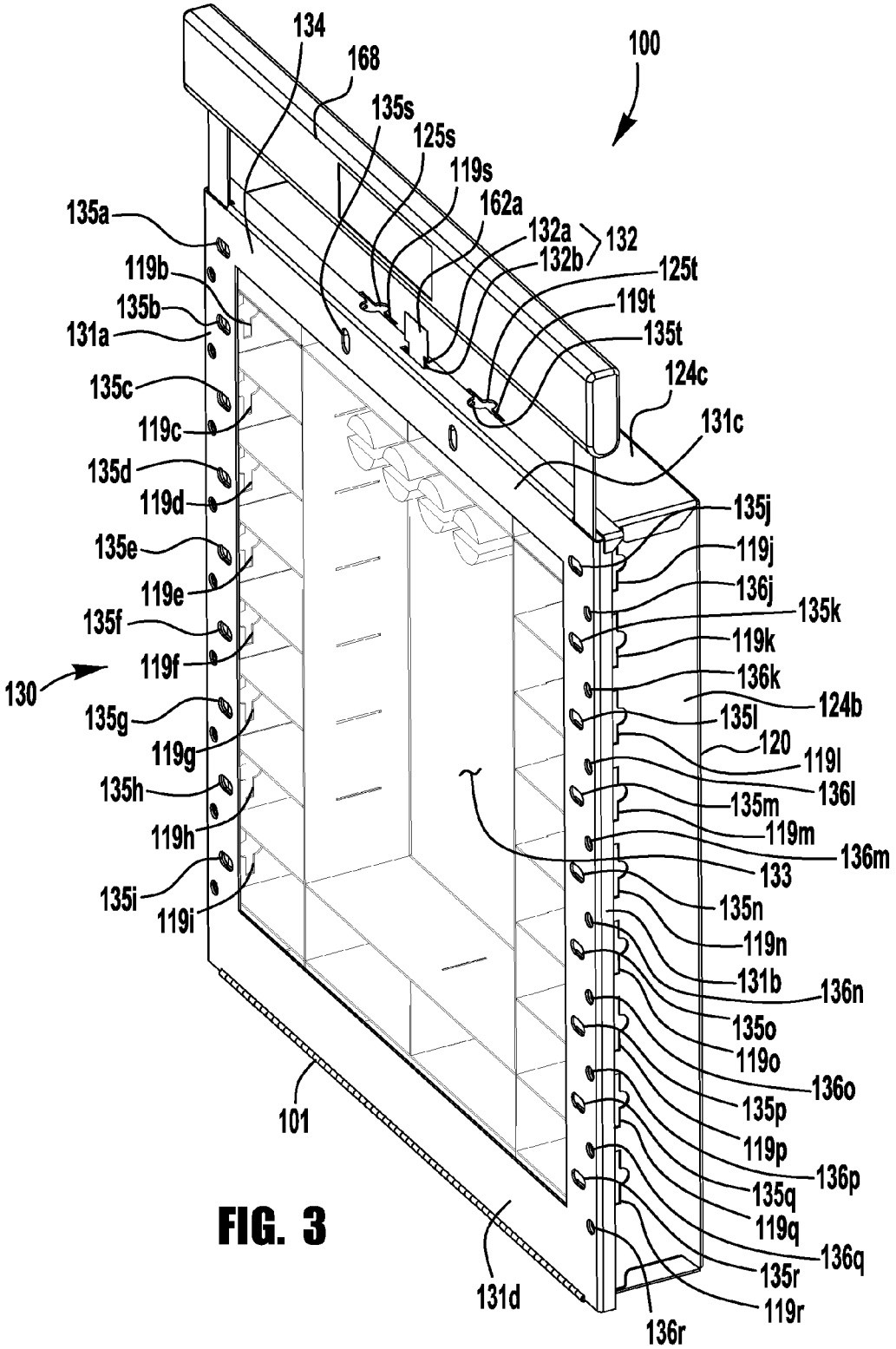
FIG. 3 illustrates an upper side perspective view of a lockbox, shown in a closed position, in accordance with an exemplary embodiment.
Figure 3A:
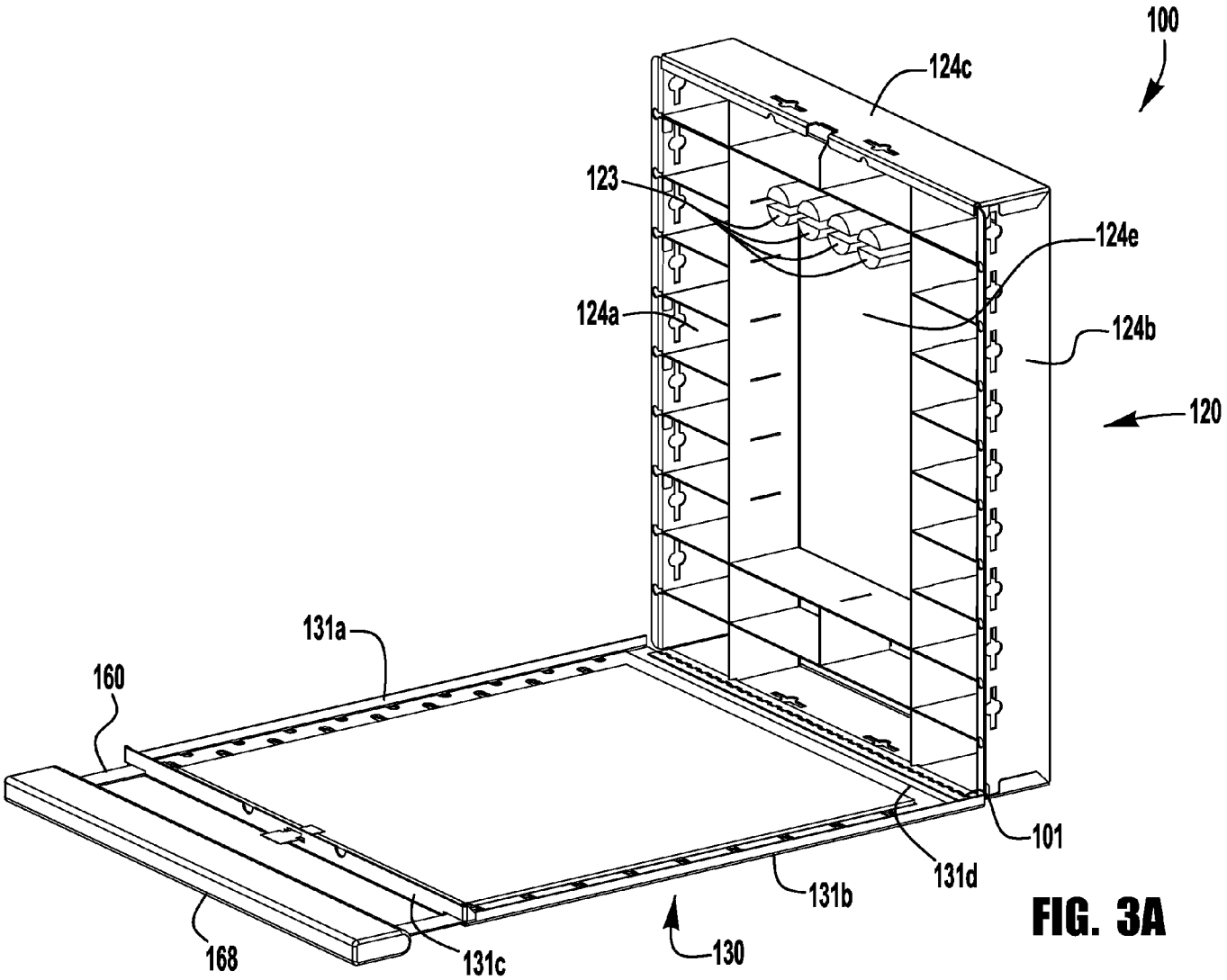
FIG. 3A illustrates an upper side perspective view of the lockbox of FIG. 3, shown in an open position.
Figure 4:
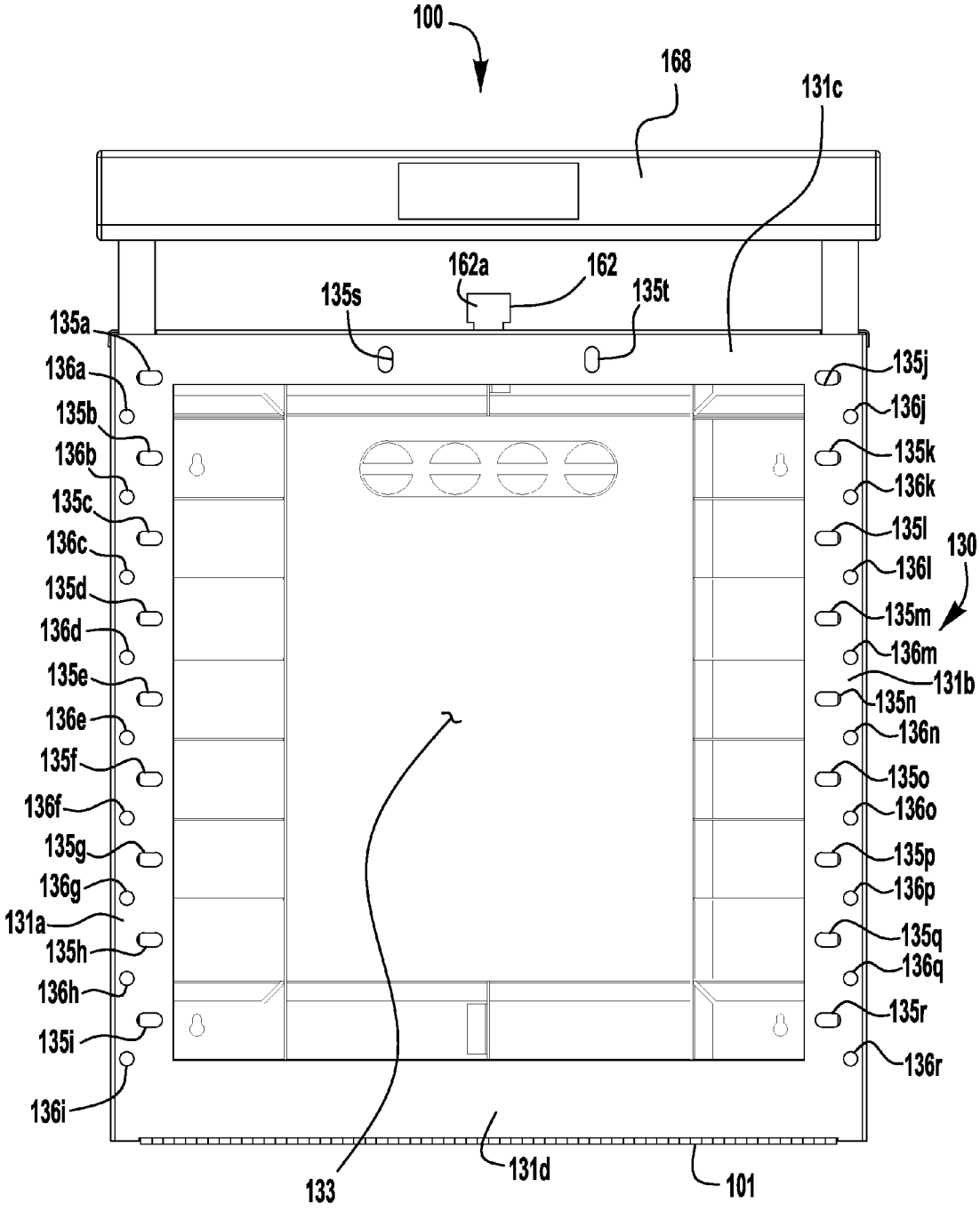
FIG. 4 illustrates a front view of the lockbox of FIG. 3.
Figure 5:
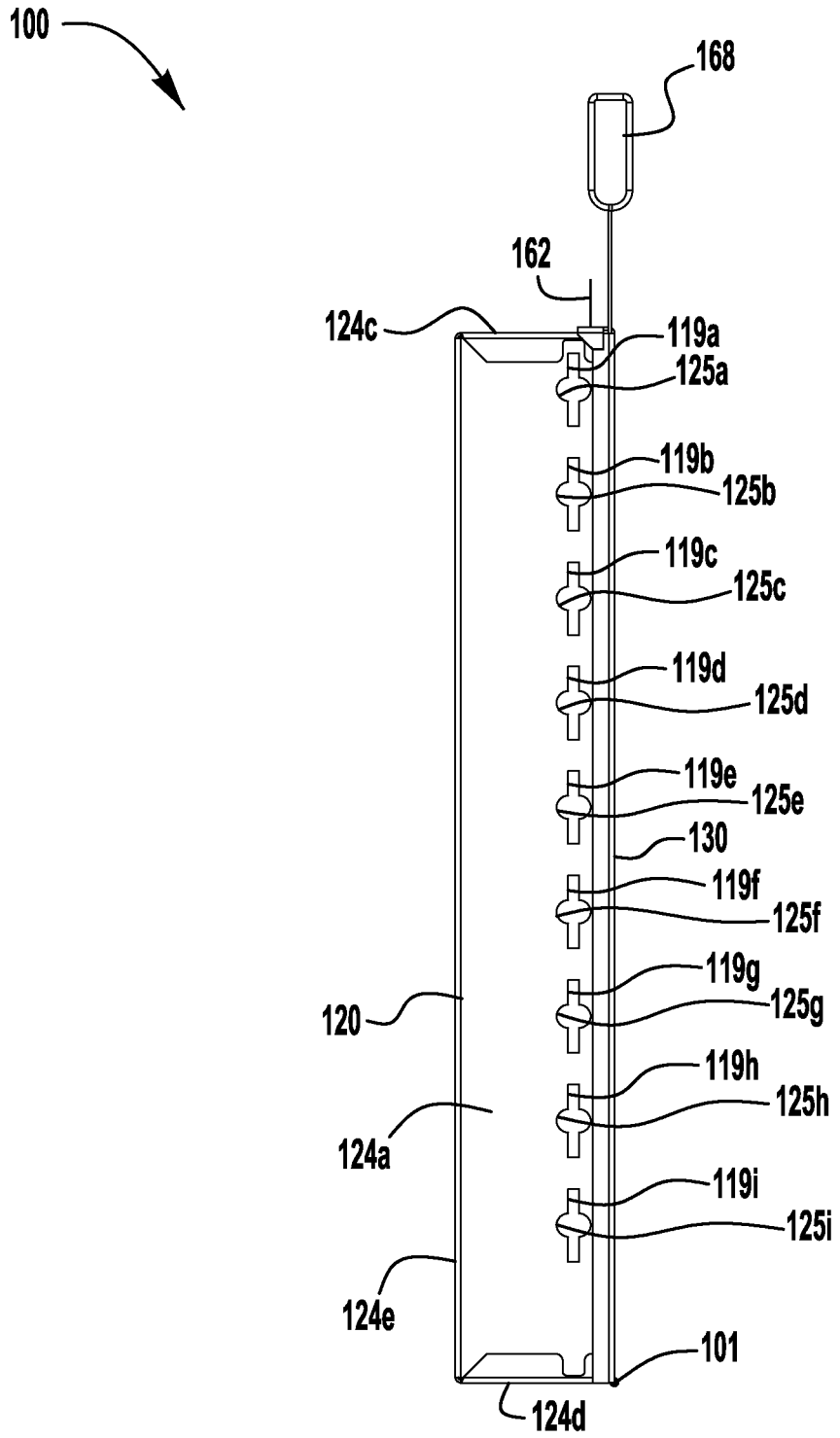
FIG. 5 illustrates a left side view of the lockbox of FIG. 3.
Figure 6:
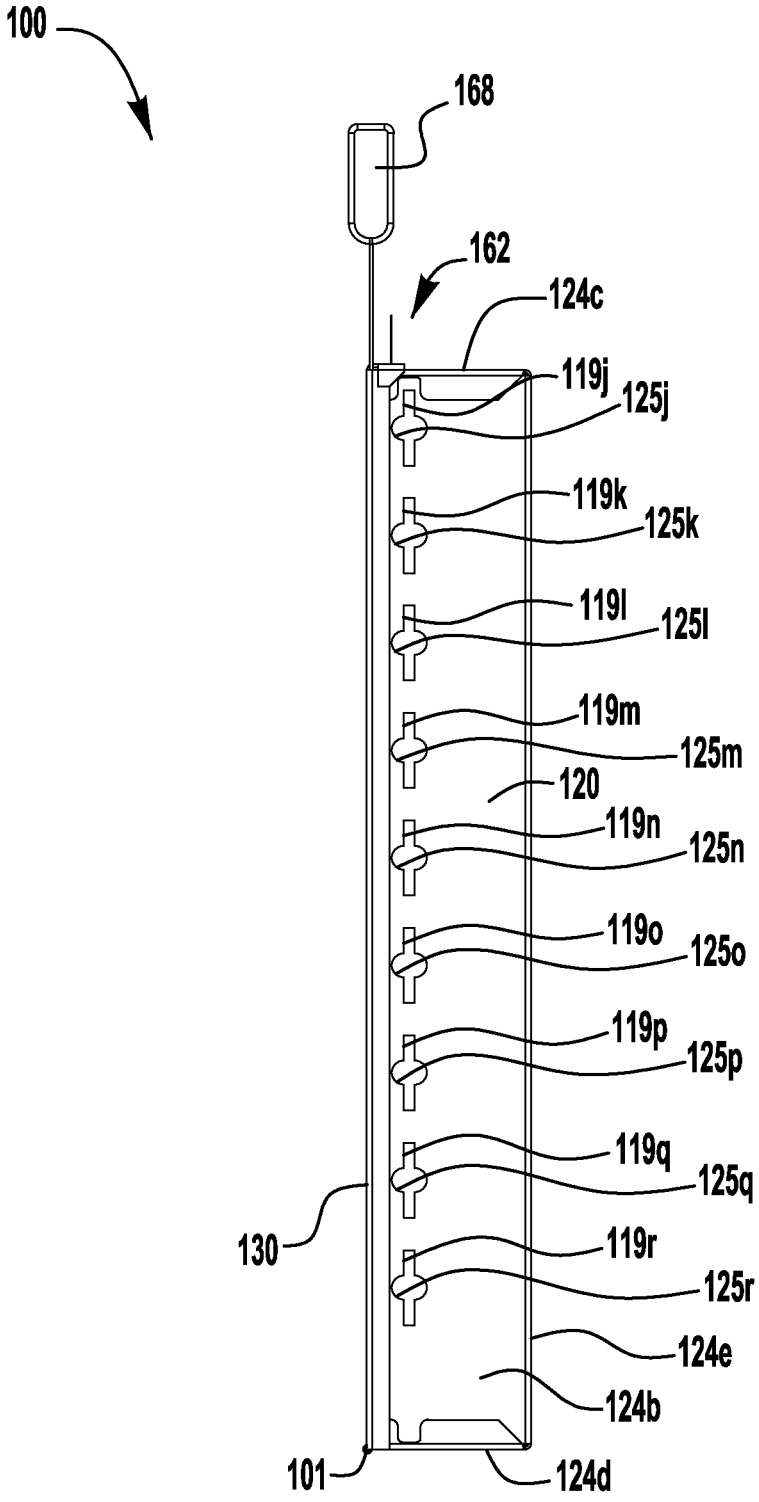
FIG. 6 illustrates a right side view of the lockbox of FIG. 3.
Figure 7:
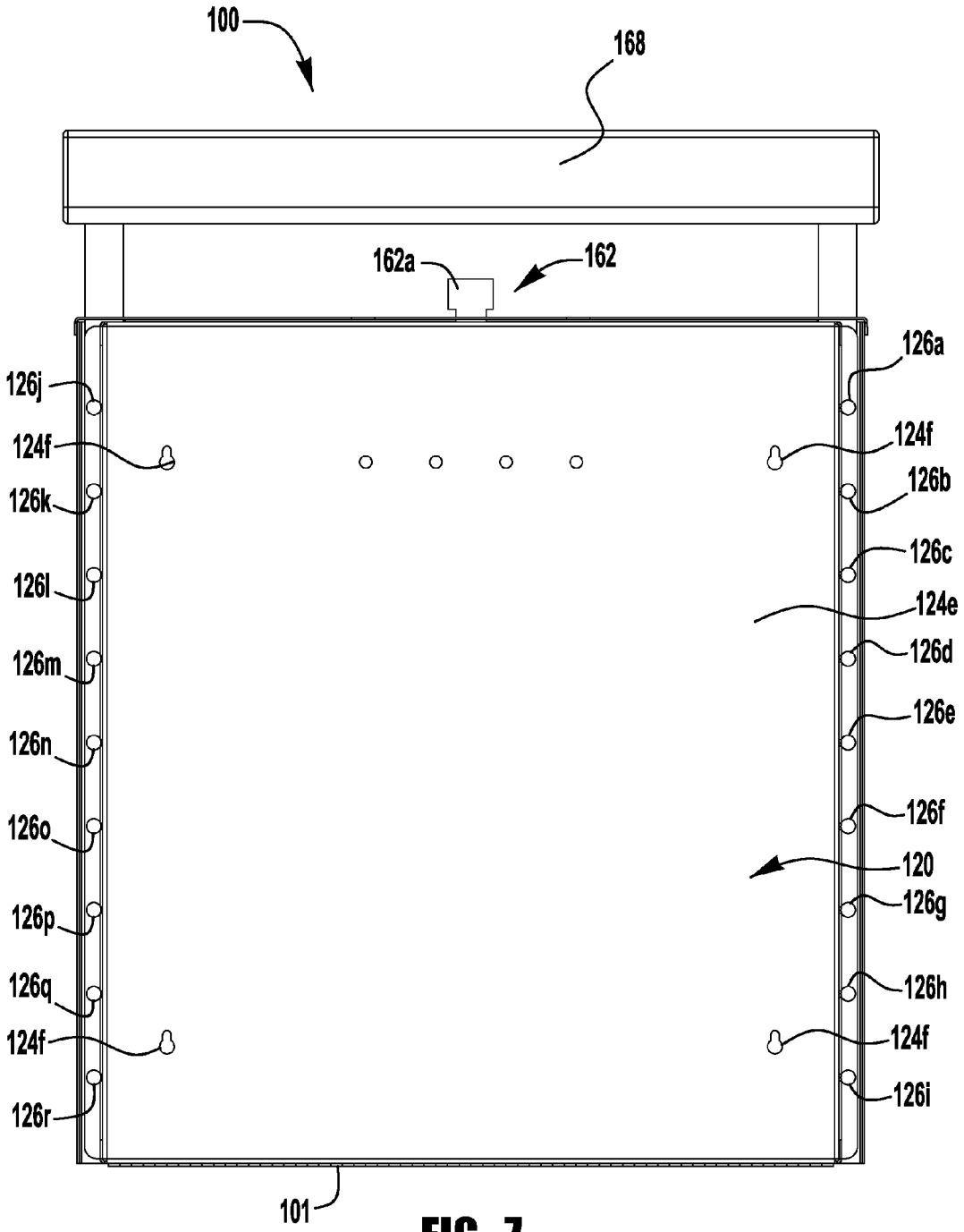
FIG. 7 illustrates a rear view of the lockbox of FIG. 3.
Figure 8:
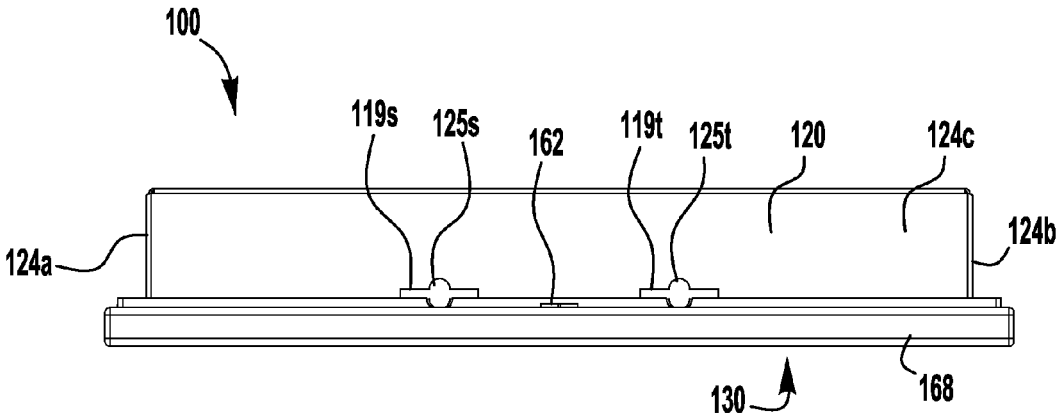
FIG. 8 illustrates a top view of the lockbox of FIG. 3.
Figure 9:
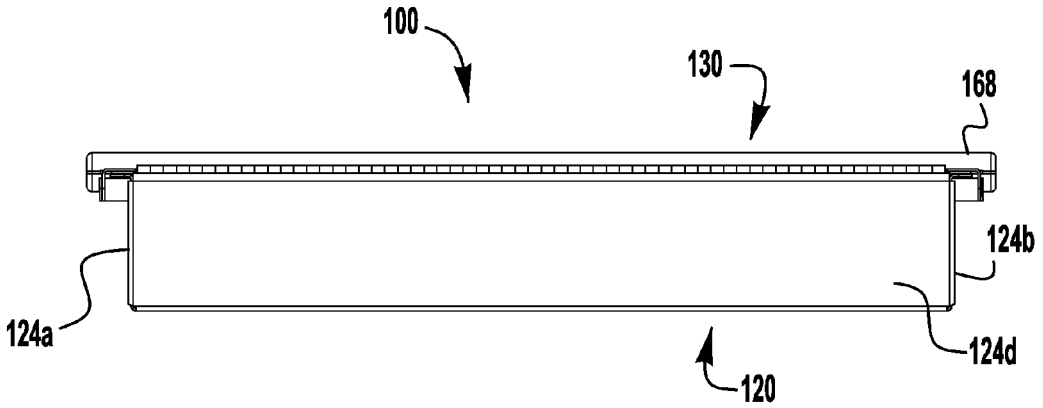
FIG. 9 illustrates a bottom view of the lockbox of FIG. 3.
Figure 10:
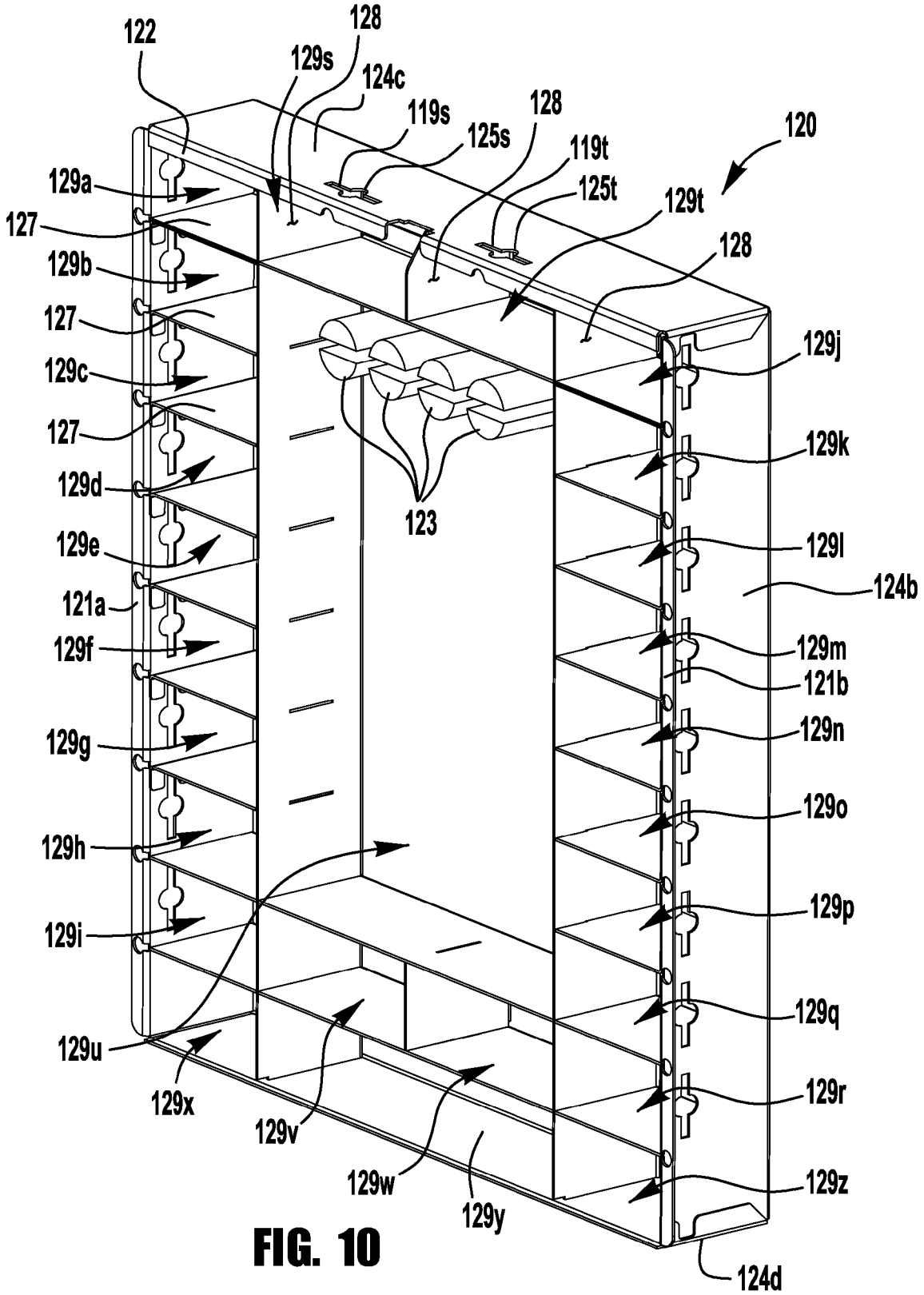
FIG. 10 illustrates a front perspective view of the body of the lockbox of FIG. 3.

FIGS. 1 and 2 schematically illustrate an exemplary lockbox 10 in accordance with the present application. The lockbox 10 includes a body 20 (with a rear wall and top, bottom, left and right perimeter walls) and a door or lid 30 together defining an enclosure 40 for retaining one or more items (e.g., keys, locks, credentials) deposited in the lockbox. The lid 30 is movable (e.g., hinged movement) with respect to the body 20 between a closed position (FIG. 1) and an open position (FIG. 2). The lockbox 10 includes multiple locking points 15*a-b* (shown as two, but may be any suitable number), with any one of the multiple locking points 15*a-b* being securable to lock the lid 30 in the closed position. In the illustrated schematic example, the locking points 15 include aligned apertures 25*a-b*, 35*a-b* in the body 20 and lid 30, positioned such that insertion of a locking member 50*a-b* (e.g., a padlock shackle) through the apertures 25*a-b*, 35*a-b* secures the lid 30 in the closed position.

In an exemplary use of a multiple user lockbox or lockout station, one or more users deposit a key, credential, or other such item into the lockbox and secures his or her assigned lock with the lockbox to prevent access to the deposited item. To allow a second or subsequent user to deposit his or her item without opening the lockbox (e.g., without requiring that the first or previous user remove or unlock the previous user's assigned lock), the lockbox may be provided with one or more slots or other such openings (e.g., in at least one of the lid and the body) sized for insertion of the item into the locked lockbox through the opening.

While one or more openings (e.g., slots) may be used to deposit multiple items from multiple users into the lockbox, in another embodiment, as shown in FIGS. 1 and 2, multiple openings 19*a-b* may be provided in the lockbox 10, with each opening being dedicated or assigned to a specific user and/or a specific deposited item. Each opening 19*a-b* may extend to a separate cavity, compartment, or receptacle 29*a-b* in the enclosure of the body 20, such that multiple deposited items 5*a-b* (e.g., system activation or lockout keys) remain separated from each other. This arrangement may facilitate distinguishing of the deposited items (e.g., multiple keys that may be similar in appearance) or identification of a particular deposited item as having been deposited by a particular user. Additionally, while the compartments 29*a-b* receiving the items may be disposed anywhere within the lockbox, in an exemplary embodiment, the compartments may be aligned with and proximate to the corresponding opening 19*a-b*, for example, to more easily (e.g., visually) associate the deposited item 5*a-b* with the corresponding assigned opening 19*a-b*, compartments 29*a-b*, and lock apertures 25*a-b*, 35*a-b*. Further, at least a portion of the compartment 29*a-b* may be visible from outside the closed lockbox 10, for example, through an at least partially transparent panel (e.g., transparent plastic such as PLEXIGLAS®, another polymer, or glass) in the lid and/or body of the lockbox 10, such that retention of the deposited item 5*a-b* in the closed lockbox 10 may be easily confirmed.

To impede efforts to remove one or more of the deposited items 5*a-b* through the opening 19*a-b*, the opening may be sized to closely receive the inserted item. The minimally sized opening may impede extraction of an item through the slot using an inserted tool, or an item from being shaken or dropped out of the lockbox through the opening. Additionally or alternatively, according to an aspect of the present application, one or more lock apertures 25*a-b* of the lockbox may be positioned such that a locking member 50*a-b* secured through the lock apertures 25*a-b*, 35*a-b* obstructs at least a portion of the opening 19*a-b*, thereby preventing the item 5*a-b* from passing through the opening.

In another exemplary embodiment of a lockbox, one or more lock apertures in at least one of a body and a lid may be positioned such that a locking member inserted through the lock apertures blocks movement of a latch mechanism out of a lid latching position. The latch mechanism may be assembled with one of the body and lid and configured to interlock with the other of the body and lid in the latching position, and to disengage from the other of the body and lid in the latching position in a releasing position to permit movement of the lid to the open position. In an exemplary embodiment, aligned or adjacent lock apertures in the body and lid may be configured such that an inserted shackle both directly secures the lid with the body in a closed position and blocks movement of a latch mechanism to a lid releasing position. One such exemplary embodiment is described in U.S. Pat. No. 7,360,380, the entire disclosure of which is incorporated herein by reference.

FIGS. 3-11 illustrate various views an exemplary lockbox 100 including a body 120 and a door or lid 130 pivotally connected to the body 120 at a hinge portion 101 for pivoting movement between a closed position and an open position. The body includes first, second, third and fourth perimeter walls 124*a-d* extending from a rear wall 124*e* to define a storage enclosure. The lid includes first, second, third, and fourth perimeter edge portions 131*a-d* that align with the perimeter walls 124*a-d* of the body 120 when the lid 130 is in the closed position. The enclosure includes a plurality of compartments 129*a-t* (FIG. 10) aligned with corresponding slots or openings 119*a-t* (FIGS. 5 and 6) in the body 120 to permit insertion of one or more items (not shown) through the openings for receipt in the body compartments while the lid 130 remains in a closed position. The lid 130 may, but need not, be provided with an at least partially transparent panel or wall portion 133 (FIGS. 3 and 4) that at least partially aligns with the compartments 129*a-t*, such that the compartments may be visually inspected through the panel 133 without opening the lid 130. A pocket or sleeve (not shown) may be provided on the inside surface of the panel 133, for example, to display signage or paperwork (e.g., lockout policies, equipment documentation, etc.) that may be visible through the panel 133, and to securely retain the signage or paperwork while the lockbox is locked out. Additionally or alternatively, a pocket or sleeve (not shown) may be provided on the outside of the panel 133, for example, to display and or retain signage or paperwork (e.g., lockout policies, equipment documentation, etc.) that may be readily accessible even when the lockbox is locked out. The external pocket or sleeve may also be at least partially transparent for visibility of the retained documentation. Additionally, a covering flap or flange may be provided either on the pocket/sleeve or on the lid 130 to protect the contents from contamination.

To secure the lid 130 in the closed position, the exemplary lockbox 100 may be provided with lock apertures 125*a-t* (FIGS. 5 and 6), 135*a-t* (FIGS. 3 and 4) in the body 120 and lid 130, with each set of corresponding lock apertures being associated with a corresponding opening 119*a-t* and compartment 129*a-t* in the lockbox body 120. The lock apertures may be sized to closely receive a padlock shackle, including for example shackles having cross-sectional diameters of approximately, 3/16 inch, 1/4 inch, 9/32 inch, 5/16 inch, 3/8 inch, and 7/16 inch, or any other suitable shackle size. The association of a user's assigned lock (secured to adjacent lock apertures 125*a-t*, 135*a-t*) with the user's deposited item disposed in the corresponding compartment can, in exemplary embodiments, be relied upon to clearly identify which user item has been secured in the lockbox. As shown, the lockbox openings 119*a-t* may be positioned to intersect the corresponding body apertures 125*a-t*, such that when a padlock shackle of a locked padlock (not shown) is inserted through the body aperture 125*a-t*, the opening 119*a-t* is at least partially obstructed, thereby preventing removal (or insertion) of an item through the opening 119*a-t*. The opening or slot may have a width of a smaller dimension than a width or diameter of the body aperture and extend beyond both ends of the lock aperture, such that the inserted shackle may be secured at a mid-point of the slot (e.g., a center point or any other mid-point between the ends of the slot), to more effectively block passage of items through (either into or out of) the slot. In an exemplary embodiment, the slots 119*a-t* have a length of approximately 1 1/4 inches, and a width or height of approximately 0.17 inches, and the body apertures 125*a-t* have a maximum width of approximately 0.57 inches (e.g., to accommodate shackles having a diameter, for example, of approximately 3/16 inch, 1/4 inch, or 9/32 inch), and a maximum length of approximately 0.42 inches, such that the slots extend from the ends of the body apertures approximately 0.42 inches on each side. In other embodiments (not shown), lockbox openings or slots may additionally or alternatively be provided in the lid at locations corresponding to one or more compartments in the lockbox body, for insertion of an item to be stored (e.g., a key) into the corresponding compartment. These lockbox openings may similarly intersect the corresponding lid lock apertures, such that an inserted padlock shackle at least partially obstructs the slot, thereby preventing removal (or insertion) of an item through the slot.

In other embodiments, the slots and openings may have other dimensions. In some exemplary embodiments, the slot is slightly longer than the item to be stored, and the openings are suitably sized to accommodate locking devices.

The compartments 129*a-t* may be defined by partitions 127, 128 extending from a rear wall 124*e* of the lockbox body 120, and may be sized to retain larger items than those insertable through the openings 119*a-t* (e.g., padlocks corresponding to the insertable keys), requiring that the lid 130 be opened to deposit these larger items.

Figure 11:
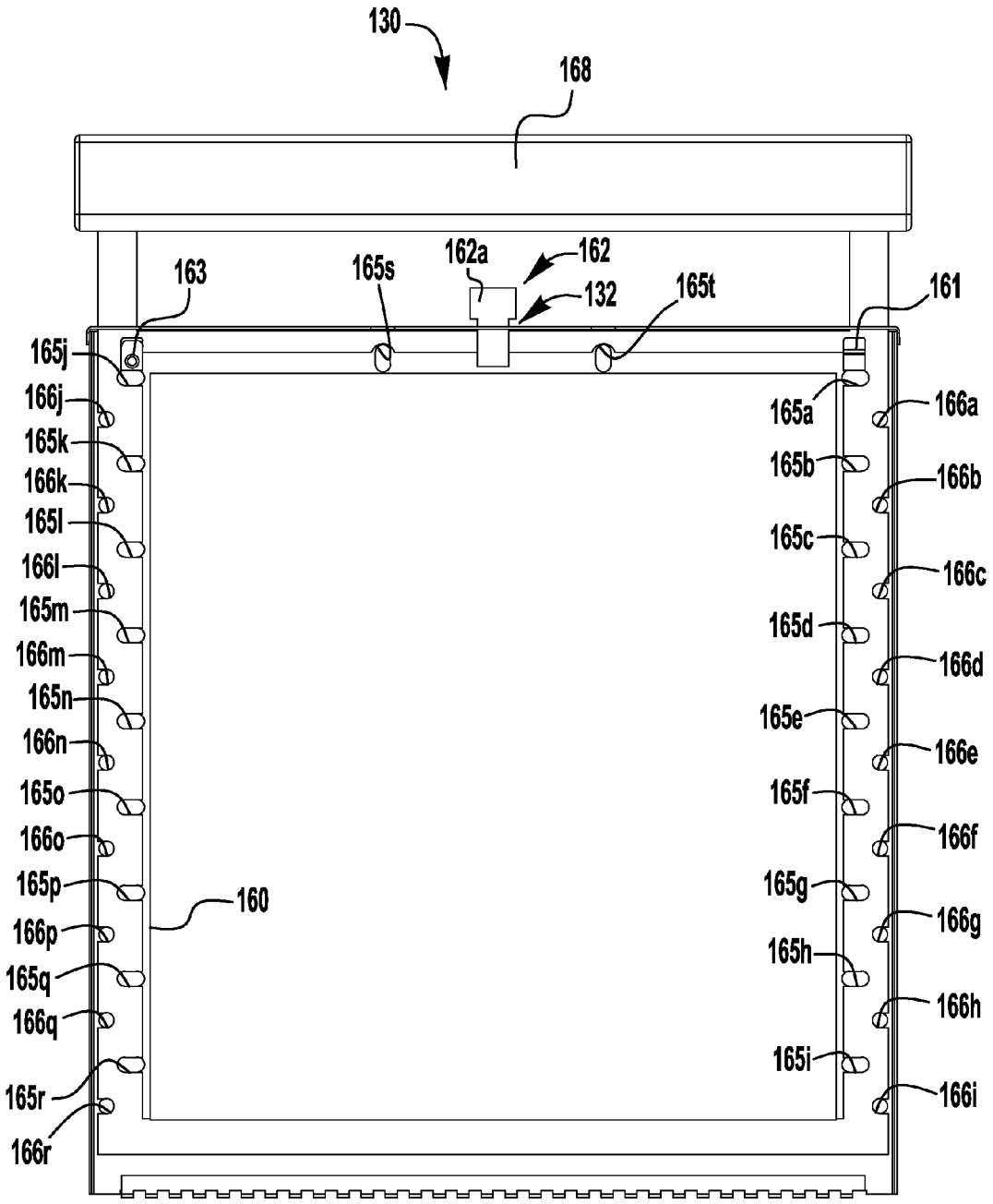
FIG. 11 is a rear view of the lid of the lockbox of FIG. 3.

To provide for more secure retention of the lockbox lid 130 in the closed position when the lockbox 100 is locked out, the lid may be provided with a latch mechanism configured to be secured in interlocking engagement with the lockbox body 120 when one or more locking members are secured through corresponding adjacent lock apertures 125*a-t*, 135*a-t* in the lockbox 100. In the illustrated example, as shown in FIG. 11, the lid 130 includes a latch frame 160 retained on an inner portion of the lid 130 and configured to slide along the inner portion of the lid 130. Other shapes, sizes, and structures of latches may additionally or alternatively be used. The latch frame 160 includes first and second latch members 161, 163 that interlock with an upper flanged edge 122 of the body 120 (FIG. 10) when the latch frame 160 is in an extended latching position, and disengage from the flanged edge 122 when the latch frame 160 is slid to a retracted releasing position. The latch frame 160 includes a series of cutouts 165*a-t* that align with corresponding apertures 135*a-t* in the lid 130 when the latch frame 160 is in the latching position. When at least one locking member is inserted through a latch frame cutout 165*a-t* and a corresponding aligned lock aperture 135*a-t*, the latch frame 160 is secured in this extended latching position. In order to slide the latch frame 160 to the releasing position, all of the locking members must be removed from the lock apertures 135*a-t* and the corresponding latch frame cutouts 165*a-t*.

As shown, the lockbox 100 may include additional or auxiliary lock apertures 126*a-r* (FIG. 7), 136*a-r* (FIG. 4) in the lockbox body 120 and lid 130 that align to confront each other, for directly securing the lid 130 to the body 120 and for securing the latch frame 160 in the latching position when at least one locking member is inserted through the aligned lock apertures 126*a-r*, 136*a-r* of the closed lockbox 100. As shown, the apertures 126*a-r*, 136*a-r* may additionally align with corresponding cutouts 166*a-r* in the latch frame 160 (FIG. 11), for securing the latch frame 160 in the latching position when at least one locking member is inserted through the aligned lock apertures 126*a-r*, 136*a-r* and cutouts 166*a-r* of the closed lockbox 100. As shown, these lock apertures 126*a-r*, 136*a-r* need not be associated with a corresponding opening for inserting items in the lockbox 100. In the illustrated embodiment, the side perimeter walls 124*a*, 124*b* include lateral extending end flanges 121*a*, 121*b* (FIG. 10) in which the auxiliary body apertures 126*a-r* are disposed. The sides of the latch frame 160 are sandwiched between the end flanges 121*a*, 121*b* and the edge portions 131*a*, 131*b* of the lid 130.

Further, to prevent inadvertent or automatic (e.g., due to gravity) opening of the lid 130 when no locking members are assembled with the lockbox lock apertures, the lid 130 may be provided with a biased mechanism that holds the latch frame 160 in the latching position and requires user manipulation of some element to allow the latch frame 160 to move to the releasing position. In the illustrated example, a spring tab 162 (FIGS. 3 and 11) is secured to an upper portion of the latch frame 160 and extends through a stepped notch 132 (FIG. 3) on an upper flange 134 of the lid 130. The spring tab 162 is biased into a narrow portion 132*a* of the stepped notch 132, such that an enlarge end 162*a* of the spring tab 162 prevents downward sliding movement of the latch frame 160 with respect to the lid 130. When the spring tab 162 is flexed into alignment with a wide portion 132*b* of the stepped notch 132, downward sliding movement of the latch frame 160 is permitted. In the illustrated example, a lid handle 168 is secured to the latch frame 160, and can be pushed or pulled to slide the latch frame from the latching position to the releasing position when the spring tab 162 is flexed into alignment with the wide portion 132*b* of the stepped notch 132.

In an exemplary method of using a lockbox, such as, for example, the lockbox 100 of FIGS. 3-11, multiple authorized individuals responsible for locking out a system are each assigned a key operated system padlocks from of a series (e.g., two or more) of key operated system padlocks (not shown). Each authorized individual uses his or her assigned system padlock to lock out one or more portions of the system (for example, for maintenance or discontinued use), for example, electrical, electromechanical or fluid system equipment. Each authorized individual inserts the authorized key corresponding to his or her assigned system padlock into an assigned opening 119*a-t* in the lockbox 100 for receipt in a corresponding compartment 129*a-t*. The authorized user then secures an assigned lockbox padlock (which may be a key operated padlock, combination padlock or other such lock, not shown) through the corresponding lock apertures 125*a-t*, 135*a-t* and latch frame cutouts 165*a-t*. Each secured lockbox padlock independently and simultaneously secures the lid 130 with the body 120 in a closed position, secures the latch frame 160 in a latching position, and blocks the corresponding opening 119*a-t* to prevent extraction of the inserted key. Each user may attach corresponding documentation to the outside of the lockbox or to the lockbox padlock itself (e.g., on a lockout label). To return the system to service, all of the authorized individuals must unlock and remove their assigned lockbox padlock from the corresponding lock apertures 125*a-t*, 135*a-t* to permit sliding movement of the latch frame 160 to the releasing position and pivoting movement of the lid 130 to the open position for removal of the deposited keys from the corresponding compartments 129*a-t*.

Still other features may be additionally or alternatively provided with a lockbox or lockout station in accordance with the present application. For example, as shown, the lockbox body 120 may further define one or more additional compartments 129*u-z* (FIG. 10) of varying shapes and sizes that are not aligned with external openings in the lockbox 100, such that the lid 130 must be opened to deposit one or more items in these compartments. One or more of the compartments may be provided with one or more item mounting elements (e.g., hooks, clips, or other fasteners) to securely store one or more items in the compartment. As an example, the illustrated lockbox 100 includes a larger compartment 129*u* in a central portion of the enclosure, having pronged posts 123 configured to grasp and retain shackle portions of padlocks (not shown) stored in the receptacle 129*u*. As another example, the lockbox 100 may further be sized to accommodate documents related, for example, to an equipment lockout procedure, either inside or outside of the lid 130. As still another example, the rear wall 124*e* of the lockbox body 120 may be provided with mounting holes 124*f* to secure the lockbox 100 to a wall or other structure.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A lockbox for use with one or more lock members, the lockbox comprising:

a body including first, second, third and fourth perimeter walls extending forward from a rear wall to a front edge to define a storage enclosure therebetween;

a lid connected to the body and pivotable between a closed position blocking access to the enclosure and an open position permitting access to the enclosure, the lid including first, second, third, and fourth perimeter edge portions that align with corresponding ones of the first, second, third and fourth perimeter walls when the lid is in the closed position;

a latch assembled with the lid and slideable between a latching position, in interlocking engagement with a latch engaging portion of the body when the lid is in the closed position, and a releasing position disengaged from the latch engaging portion of the body;

wherein the first perimeter wall includes a first end flange extending laterally outward from the first perimeter wall front edge, the first end flange being positioned to abut the first perimeter edge portion of the lid when the lid is in the closed position, the first end flange including a first body aperture that aligns with a first lid aperture in the first perimeter edge portion of the lid, such that when a lock member is inserted through the first body aperture and the first lid aperture, the lock member does not extend into the storage enclosure, and pivoting movement of the lid from the closed position to the open position is prevented;

further wherein when the latch is in the latching position, a first cutout of the latch aligns with the first lid aperture, such that insertion of a lock member through the first body aperture and the first lid aperture further prevents sliding movement of the latch from the latching position to the releasing position.

2. The lockbox of claim 1, wherein the second perimeter wall includes a second end flange extending laterally outward from the second perimeter wall front edge, the second end flange being positioned to abut the second perimeter edge portion of the lid when the lid is in the closed position, the second end flange including a second body aperture that aligns with a second lid aperture in the second perimeter edge portion of the lid, such that when a lock member is inserted through the second body aperture and the second lid aperture, the lock member does not extend into the storage enclosure, and pivoting movement of the lid from the closed position to the open position is prevented.

3. The lockbox of claim 1, wherein the first perimeter wall includes a second body aperture disposed in the first perimeter wall, and the first perimeter edge portion includes a second lid aperture positioned adjacent to the second body aperture when the lid is in the closed position, such that insertion of a lock member through the second body aperture and the second lid aperture prevents pivoting movement of the lid from the closed position to the open position.

4. The lockbox of claim 3, further wherein when the latch is in the latching position, a second cutout of the latch aligns with the second lid aperture, such that insertion of a lock member through the second body aperture and the second lid aperture further prevents sliding movement of the latch from the latching position to the releasing position.

5. The lockbox of claim 1, further comprising first and second compartments disposed in the enclosure.

6. The lockbox of claim 3, wherein the first body aperture and first lid aperture are aligned with the first compartment, and the second body aperture and second lid aperture are aligned with the second compartment.

7. The lockbox of claim 5, wherein at least one of the body and the lid includes a transparent wall portion for visual inspection of the first and second compartments when the lid is in the closed position.

8. The lockbox of claim 5, wherein the first and second compartments are separated by a central portion of the enclosure.

9. The lockbox of claim 8, wherein the central portion of the enclosure includes at least one post affixed to the rear wall of the body and configured to retain at least one padlock in the central portion of the enclosure.

* * * * *